United States Patent [19]

Arbiter

[11] 4,218,952

[45] Aug. 26, 1980

[54] DRUM TENSIONING

[75] Inventor: Ivor D. Arbiter, London, England

[73] Assignee: CBS/Arbiter Limited, London, England

[21] Appl. No.: 879,776

[22] Filed: Feb. 21, 1978

Related U.S. Application Data

[63] Continuation of Ser. No. 613,919, Sep. 16, 1975, abandoned.

[30] Foreign Application Priority Data

Sep. 16, 1974 [GB] United Kingdom ..... 40311/74

[51] Int. Cl.[2] ..... G10D 13/02

[52] U.S. Cl. ..... 84/411 A; 84/458

[58] Field of Search ..... 84/411, 411 A, 413, 84/419

[56] References Cited

U.S. PATENT DOCUMENTS

| | | | |
|---|---|---|---|
| 794,658 | 7/1905 | Boulanger | 84/411 R |
| 1,284,526 | 11/1918 | Winne | 84/411 A |
| 2,550,249 | 4/1951 | Hall | 84/411 A |

FOREIGN PATENT DOCUMENTS

| | | | |
|---|---|---|---|
| 6311 | of 1887 | United Kingdom | 84/411 A |

*Primary Examiner*—Lawrence R. Franklin

*Attorney, Agent, or Firm*—Gausewitz, Carr, Rothenberg & Edwards

[57] ABSTRACT

For tensioning a drum head, a counter hoop bearing on the rim of the drum head is formed to define an annular channel between itself and the drum shell over which the drum head is stretched. Co-operating camming means extend into this annular channel from the inner surface of the counter hoop and from the outer surface of the drum shell, respectively, so that upon rotation of the counter hoop about the axis of the drum, the counter hoop is simultaneously moved parallel to that axis to alter the tension in the drum head.

3 Claims, 6 Drawing Figures

DRUM TENSIONING

This is a continuation of application Ser. No. 613,919, filed Sept. 16, 1975, now abandoned.

This invention is concerned with drums and in particular with devices for tensioning drum heads.

In conventional drums, the skin of the drum head is stretched over an open end of a cylindrical shell, which constitutes the side wall of the drum and is tensioned by means of circumferentially spaced bolts extending parallel to the axis of the drum and acting on a counter hoop which bears on the rim (flesh hoop) at the periphery of the drum head. Tightening of the bolts pulls on the counter hoop and therefore on the rim and tensions the drum head. The greater the number of tensioning bolts, the less is the angle between the tensioning points and therefore the more even is the tension on the skin. However, the adjustment of a large number of bolts takes time and it also requires some skill if the tension is to be substantially even throughout the skin.

Over a period of more than 50 years, proposals have been made from time to time to vary the tension of a drum head by cam action based on rotation of a cam band about the drum axis. To the best of our knowledge, no drum based on these proposals has been commercially produced and none of the proposals has been successful. A difficulty with these prior proposals lies in the excessive friction produced between the rotating cam band and some other surface of the drum. An example of such prior proposals is the drum shown in U.S. Pat. No. 2,051,671, which relies upon the rotation about the axis of the drum, by means of a rack and pinion, of a cam band having a sawtooth edge, one side of the band lying against and rotating over the inner surface of the drum shell and the sawtooth edge co-acting with pins fixed to the counter hoop and passing through vertical slots in the drum shell. Other proposals have included the provision, between outer and inner walls of the counter hoop, of two equal-diameter cam bands having on adjacent edges sawtooth teeth which ride upon one another when the bands are rotated in opposite directions between the two walls by means of a rack and pinion (U.S. Pat. No. 2,115,741); the provision of cam slots in a rotatable inner tuning band lying against the drum shell, the pins passing through the drum shell into the slots (U.S. Pat. No. 2,550,249); and the provision of a cam band in the form of two semi-circular band portions sliding over the external surface of a drum shell, the two portions having one pair of adjacent ends sliding in guides and the other pair of adjacent ends formed with threaded terminals which extend into a nut having oppositely threaded ends, so that rotation of the nut in one direction pulls the semi-circular bands around the shell towards the nut or pushes these semi-circular bands away from the nut so that their ends slide back into the guides (U.S. Pat. No. 1,284,526). In the last mentioned patent, cam followers in the form of rollers are mounted on pivoted hasps attached to the counter hoop.

In all of these prior proposals there is sliding movement of one cylindrical surface (that of the cam band) over another cylindrical surface, which is that of the shell or counter hoop.

A drum according to the present invention comprises: a cylindrical drum shell and a drum head extending over an open end of the drum shell and bounded by a circumferential hoop lying outside the drum shell; a counter hoop bearing on the hoop of the drum head for tensioning the drum head, the drum shell and a portion of the counter hoop which encircles the drum shell forming between them an annular channel; co-operating camming means extending into the annular channel from the drum shell and counter hoop respectively, the camming means including a number of cam slides, spaced around the annular channel, each cam slide extending in the direction of its length part way round the annular channel, and all cam slides making the same angle, in the direction of their lengths, with a plane perpendicular to the drum axis; and means for rotating the counter hoop about the drum axis with respect to the drum shell and, by virtue of the camming means, simultaneously moving the counter hoop axially to vary the tension of the drum head.

In the preferred form, the said cam slides are fixed to the counter hoop, each cam slide projecting in the direction of its width inwards from the inner surface of the counter hoop; the camming means further comprises a roller for each cam slide extending outwards from the drum shell so that the line of contact between each roller and its cam slide lies substantially radially across the width of the cam slide; and the means for rotating the counter hoop comprises a rack fixed to the counter hoop extending part way round the said annular channel at the same angle as the said cam slides, and a pinion fixed to the shell for engagement with the rack.

By placing the cams and rollers directly on the counter hoop and shell so that they lie in an annular channel between the counter hoop and shell and have a radial line of contact with one another, and leaving spaces between the cams to permit them to pass between the rollers when the counter hoop is put in place, the cam effect being obtained by rotation of the counter hoop, the provision of an additional cylindrical cam band rotating against another cylindrical surface is rendered unnecessary. The construction is greatly simplified and the friction is reduced to such an extent that tuning of a drum by means of the single rack and pinion is made possible.

Advantageously, there are at least four cam slides and in our preferred form of drum there are six.

The forming of the rack integrally with one cam slide is of considerable importance. The reasons for this are as follows. When the counter hoop is placed on the drum head it must be moved to an angular position such that the cam slides pass between the rollers, after which the counter hoop is given a turning movement to bring the cam slides and rollers into engagement. If the rack is not aligned with a cam slide in the axial direction of the drum, it limits the space available in the rotary direction for introducing the cam slides between the rollers and necessitates shortening of the cam slides. Additionally, the integral formation of the rack and cam slide results in much greater mechanical strength, because the pinion acts on one side of the combined rack and cam slide whilst the roller (or in the preferred form, pair of rollers) acts on the other side of the cam slide. This is of great importance in view of the very high tensions required in modern drum heads and the high forces consequently exerted on the rack.

A further feature resulting in strengthening of the cam slides is the provision of a downturned lip at their edge remote from their fastening to the counter hoop. This downturned lip resists the tendency of the cam slide to buckle under the force imposed upon it by the roller or pair of rollers.

Another feature which is of some importance is that lateral movement of the drum head over the drum shell should be reduced as much as possible. In conventional drums, the drum head is "floating", from the point of view of lateral movement with respect to the shell and counter hoop; it might have been thought that this lateral "floating" arrangement of the drum head would have permitted some lateral movement of the drum head in response to uneven tensions around the diaphragm surface and might therefore have been an advantage. Surprisingly, we have found that such a "floating" mounting is undesirable in tensioning arrangements embodying the present invention. We believe that the reason for this is that when the counter hoop is rotated with respect to the drum head, if the drum head has too much lateral play it tends to pull unevenly over the end of the drum shell. Consequently, in our preferred arrangement we arrange that the difference between the inner diameter of the counter hoop where it passes over the drum shell and the outer diameter of the drum shell at this point is not greater than 0.015 inches. In fact, the free space once the drum head diaphragm is in place between the counter hoop and drum shell should be as small as possible.

We have found that with this preferred drum, if the tuning is even at one pitch, its evenness is maintained when the tension of the drum head is increased to bring it to another pitch. However, in some cases due to irregularities in drum heads, for example, even tuning is not obtained when the drum head is first placed on the drum and consequently in our preferred drum we provide additionally a fine tuning ring between the shoulder of the counter hoop and the rim or flesh hoop of the drum head, with means for adjusting the slope of the counter hoop relative to the additional ring. Such means may comprise, for example, a number of circumferentially spaced screws passing through internally threaded holes in the counter hoop and bearing on the additional tuning ring, each screw being individually adjustable to control the spacing between the counter hoop and the additional ring at the location of that screw.

In order that the invention may be better understood, one form of drum embodying the invention will now be described with reference to the accompanying drawings, in which.

Figure 1:
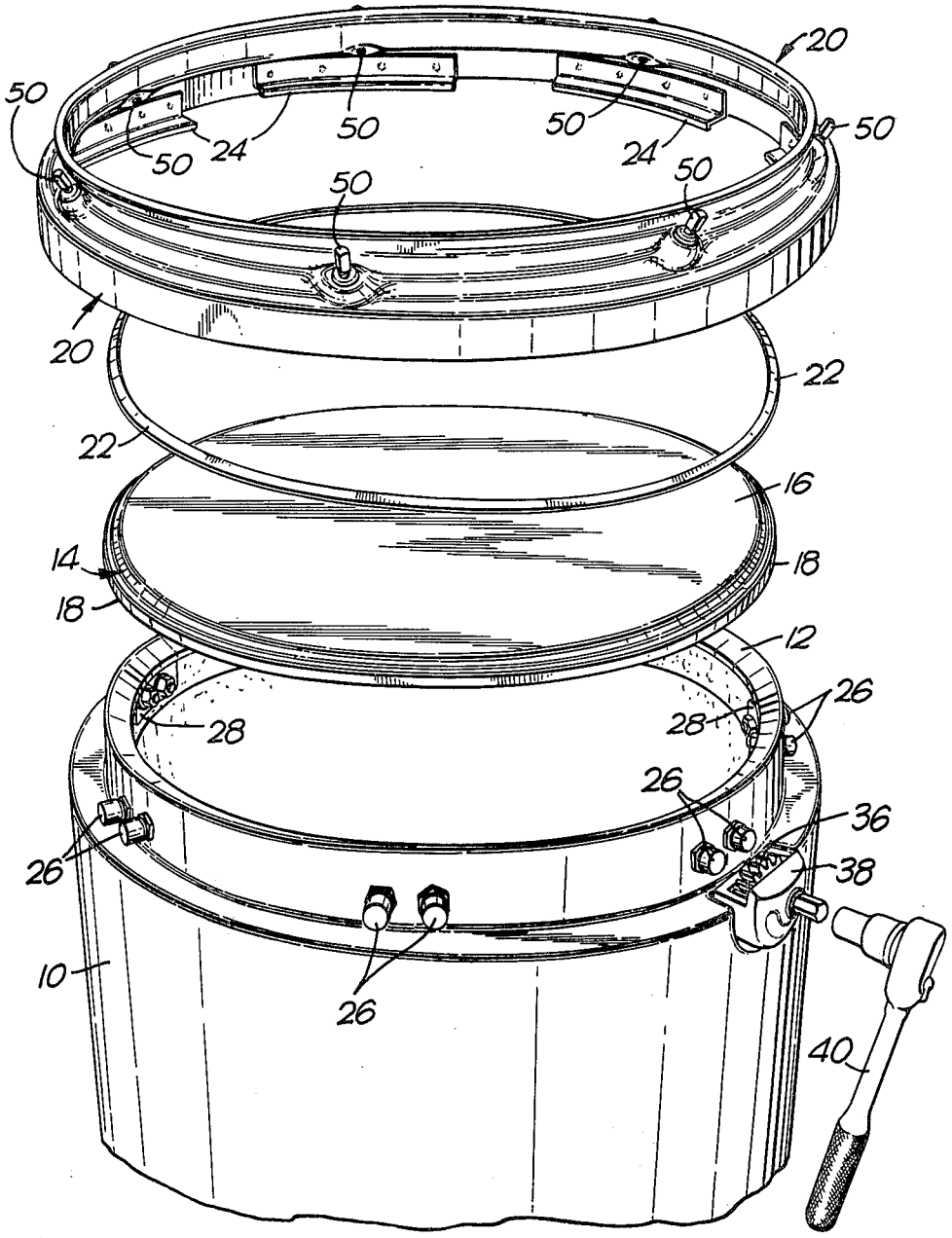
FIG. 1 is an exploded view of the drum, drum head and tensioning means.

In the drawings, a drum shell 10 has an open end 12 on which sits a drum head 14 consisting of a diaphragm 16 and a rim or flesh hoop 18. When the drum head is placed on the shell 10, the flesh hoop 18 lies outside the periphery of the open end 12 of the drum. The drum head is tensioned by means of a tensioning ring or counter hoop 20, acting through an intermediate ring 22 on the flesh hoop 18 of the drum head. Tensioning is effected by pulling the counter hoop in a direction parallel to the drum axis and to effect this six cam slides 24 are fixed to the inner surface of the counter hoop and six pairs of rollers 26 are fixed so as to project radially outwards from the cylindrical surface at the top of the drum shell. Each pair of rollers is fixed through the drum shell and through a supporting plate 28 (FIG. 1) on the inside of the drum shell.

Figure 2:
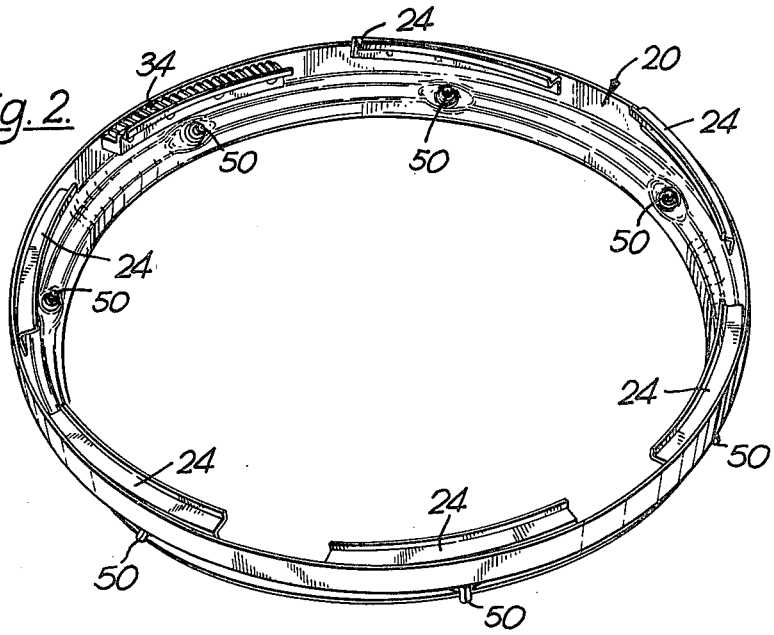
FIG. 2 is a perspective view from below of the counter hoop.
Figure 3:
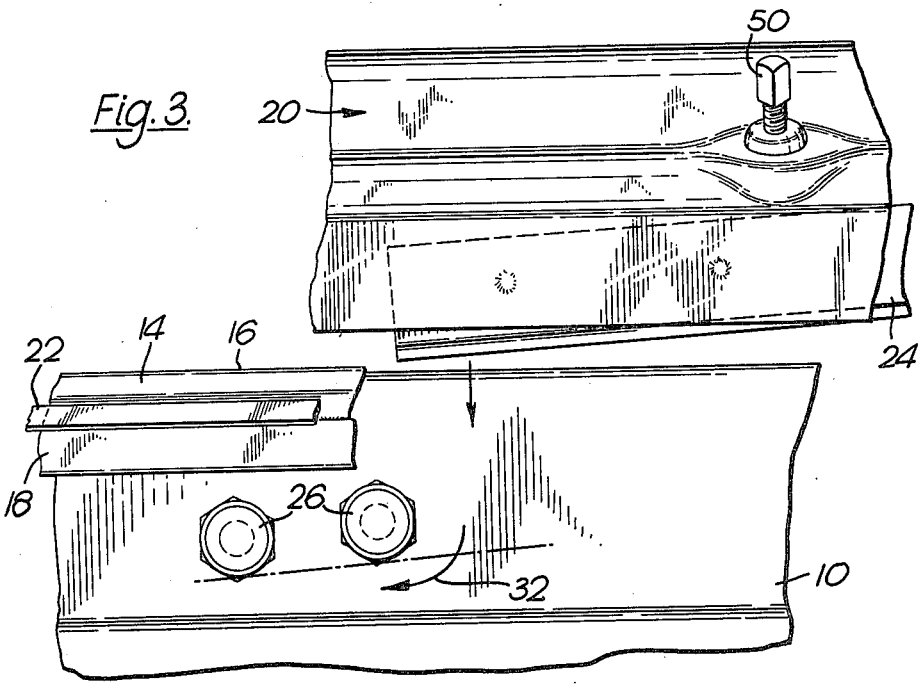
FIG. 3 illustrates the manner in which the cam slides of the counter hoop are passed between rollers when the counter hoop is placed over the drum head.
Figure 4:
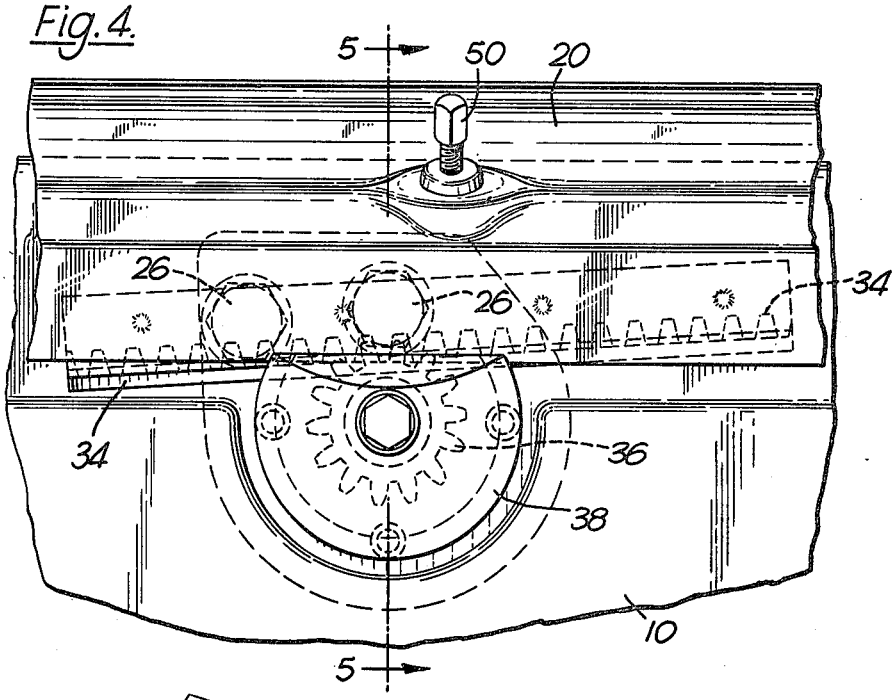
FIG. 4 illustrates a portion of the counter hoop and drum shell and the underlying rack and pinion.

It will be seen that when the counter hoop is placed over the drum head in the manner shown in FIG. 3 (that is to say by axial movement of the counter hoop in an angular position, relative to the drum shell, such that the cam slides pass between one pair of rollers and the next pair) subsequent angular movement of the counter hoop in the direction indicated by the arrow 32 will bring the cam slides under the rollers, further angular movement pulling the counter hoop further on to the flesh hoop of the drum and thereby tensioning the drum head. To facilitate such rotary movement, we provide a rack 34 integrally with one of the cam slides (see FIGS. 2, 4 and 5) and a pinion 36 in a housing 38 fixed to the drum shell, for engagement with the rack 34. As shown in FIG. 1, the pinion is located substantially under one pair of rollers 26 so that when the lower ends of the cam slides engage under the rollers, the rack engages with the pinion. The pinion can be rotated by means of a tool 40, FIG. 1.

As stated above, the formation of the rack integrally with a cam slide has the advantage of permitting the cam slides to be longer and this means that their angle of slope can be reduced, thereby facilitating the rotation of the counter hoop. The preferred angle of slope is between 1/20 and 1/30, the value of 1/25 being used in the drum illustrated in the drawing. The rack makes the same angle as the cam slides with a plane perpendicular to the drum axis and, as shown in FIG. 3, each pair of rollers is arranged at this same slope.

Figure 6:
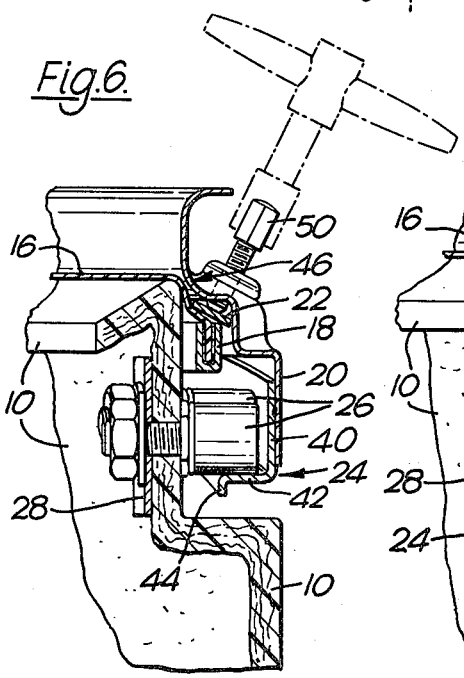
FIG. 6 is a view similar to that of FIG. 5 but taken at another point on the periphery of the drum.

As best shown in FIG. 6, each cam slide comprises a cylindrical wall 40 welded to the inner surface of the counter hoop, the cam surface 42 on which rides the cam follower roller 26 and a downturned lip 44, provided for strengthening purposes. Without the downturned lip, there would be a tendency for the cam slide to buckle under the effect of the load imposed by the rollers 26.

Advantageously there are at least twelve teeth on the pinion 36, and preferably fourteen teeth.

The provision of a pair of rollers for each rack distributes the load imposed on the rack without taking up an excessive amount of the circumferential space available for introducing the cam slides between the rollers when the counter hoop is placed on the drum head.

Figure 5:
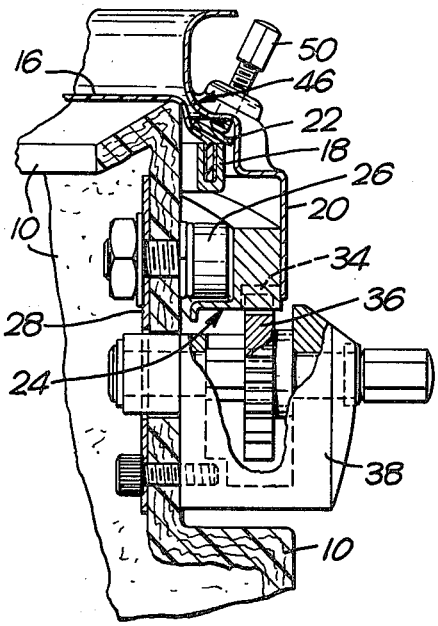
FIG. 5 is a view taken on the line 5—5 of FIG. 4, showing the rack and pinion in cross-section.

In the drum shown in the drawings, the shell 10 is of fiberglass and the drum head diaphragm 16 is of a plastic material. As shown in FIGS. 5 and 6, at the top of the drum shell the fibreglass edge slopes obliquely inwards, providing a small radiused bearing surface for the drum head diaphragm 16.

As explained above, we reduced the lateral play available for the drum head to a fraction of the conventional value. This lateral play is the space between the counter hoop and drum shell indicated by the arrow 46 in FIG. 5 (in which the distance has been exaggerated for clarity). On each side of the drum, this distance is preferably less than 0.015 inches. As explained above, by thus restricting the lateral movement of the drum head we ensure that a drum head which is evenly tuned at one pitch will still be evenly tuned when tensioned to another pitch.

We have referred above to the intermediate ring 22. This is a fine tuning ring which may in some cases be necessary to achieve even tuning over the whole of the drum head. Six set screws 50 pass through a shoulder on the counter hoop 20 and, when the drum components are assembled, bear on the ring 22 (FIGS. 5 and 6). The ring 22 in turn bears on the flesh hoop 18 of the drum head. It will be seen that by suitable adjustment of the set screws 50, in the manner shown in FIG. 6, the distance between the shoulder of the counter hoop and the flesh hoop can be made to vary from point to point in the drum periphery, thereby varying the drum head tension from point to point. These adjustments are made until even tuning is obtained and this even tuning will then be maintained during alteration of the drum head tension by rotation of the counter hoop. As shown in the drawings, one set screw is located over each cam slide.

If desired, a tensioning gauge can be placed on the drum, in the form of a scale on the drum shell and a reference mark on the counter hoop. This permits a required degree of tension to be obtained by rotation of the counter hoop to the required gauge reading.

The invention permits an ease and rapidity of tuning which is not possible with conventional drums. The large areas of sliding contact which were necessary in the above-mentioned earlier proposals have been eliminated with the result that friction is a small fraction of its value in these earlier designs; this permits obtaining a drum head tension which would not have been possible in the earlier designs. Additionally, the design is mechanically simple. The invention also has the advantage that it permits a very rapid change of drum heads when this is required.

The cam slides may be formed with a tapered "leading edge" to facilitate the initial engagement of these slides under the rollers.

Although we have illustrated the use of cam slides and rollers, it would be possible to replace the rollers by further cam slides spaced round the annular channel. However, this increases the friction (although it is still much less than with the cylindrical cam bands of the earlier proposals) and it is less desirable than the cam-roller design described above.

I claim:

1. A drum comprising:

a cylindrical drum shell and a drum head extending over an open end of the drum shell and bounded by a circumferential hoop lying outside the drum shell;

a counter hoop bearing on the hoop of the drum head for tensioning the drum head, the drum shell and the counter hoop forming between them an annular channel;

co-operating low-friction camming means and tensioning means extending into the annular channel, one from the drum shell and the other from the counter hoop, the camming means including a number of separate cam slides, spaced around the annular channel, each cam slide extending in the direction of its length only part way round the annular channel, and all cam slides making the same angle, in the direction of their lengths, with a plane perpendicular to the drum axis, the camming and tensioning means being so disposed that the one of them which extends from the drum shell overlies the other and contacts the other only through the undersurface of the overlying one and the upper surface of the underlying one along an area which neither increases nor decreases during rotation of the counter hoop about the drum axis, so that rotation of the counter hoop about the drum axis is not excessively hampered by friction and moves the counter hoop axially of the drum; the camming and tensioning means also being so constructed and so related to each other that said counter hoop may be lifted off said drum shell when said counter hoop and drum shell are in predetermined relative rotated positions;

means for rotating the counter hoop about the drum axis with respect to the drum shell and, by virtue of the camming means and tensioning means, thereby simultaneously moving the counter hoop axially to vary the tension of the drum head;

an additional ring between the counter hoop and the drum head hoop and through which the counter hoop bears on the drum head hoop; and means for adjusting the slope of the counter hoop relative to the additional ring.

2. A drum according to claim 1, including a number of circumferentially spaced screws passing through holes in the counter hoop and engaging the said additional ring, each screw being individually adjustable to control the spacing between the said counter hoop and the additional ring.

3. A drum comprising:

a cylindrical drum shell and a drum head extending over an open end of the drum shell and bounded by a circumferential hoop lying outside the drum shell;

a counter hoop bearing on the hoop of the drum head for tensioning the drum head, the drum shell and the counter hoop forming between them an annular channel;

co-operating camming means and tensioning means extending into the annular channel, one from the drum shell and the other from the counter hoop, the camming means including a number of cam slides, spaced around the annular channel, each cam slide extending in the direction of its length part way round the annular channel, and all cam slides making the same angle, in the direction of their lengths, with a plane perpendicular to the drum axis, the camming and tensioning means being so related to each other that rotation of the counter hoop about the drum axis moves the counter hoop axially of the drum;

and means for rotating the counter hoop about the drum axis with respect to the drum shell and, by virtue of the camming means and tensioning means, thereby simultaneously moving the counter hoop axially to vary the tension of the drum head, in which the drum includes a number of circumferentially spaced screws extending through said counter hoop and adapted, when individually adjusted, to exert pressure upon said circumferential hoop which bounds said drum head, and thus change the tension at different regions of the drum head.

* * * * *